United States Patent [19]

Globus

[11] 4,328,004

[45] May 4, 1982

[54] STABILIZATION OF ETHANOL-GASOLINE MIXTURES

[75] Inventor: Alfred R. Globus, Bayside, N.Y.

[73] Assignee: United International Research, Inc., Hauppauge, N.Y.

[21] Appl. No.: 177,589

[22] Filed: Aug. 13, 1980

[51] Int. Cl.[3] ..... C10L 1/02

[52] U.S. Cl. ..... 44/56

[58] Field of Search ..... 44/56; 252/309, 390, 252/392

[56] References Cited

U.S. PATENT DOCUMENTS

| | | | |
|---|---|---|---|
| 1,423,048 | 7/1922 | Tunison | 44/56 |
| 1,474,982 | 11/1923 | Schreiber | 44/56 |
| 1,869,486 | 8/1932 | Lantz | 44/56 |
| 3,822,119 | 7/1974 | Frech et al. | 44/56 |
| 4,154,580 | 5/1979 | Landis | 44/56 |

*Primary Examiner*—Patrick Garvin
*Assistant Examiner*—Y. Harris-Smith
*Attorney, Agent, or Firm*—Evelyn M. Sommer

[57] ABSTRACT

A stabilized composition of matter comprising a fuel oil, such as gasoline, ethanol, small amounts of water and a stabilizing amount of an additive which is substantially insoluble in water, but which is soluble in ethyl alcohol and gasoline and is effective to prevent the separation of the gasoline-ethyl alcohol solution into two distinct phases; said additive being n-hexylalcohol, hereinafter, n-hexanol. The invention also includes a method for stabilizing gasoline, that is, for preventing or retarding the phase separation of gasoline-ethanol mixtures in the presence of small amounts of water, and this being the case when the temperature of the gasoline-ethanol mixture has been reduced to below 20° F.

9 Claims, No Drawings

STABILIZATION OF ETHANOL-GASOLINE MIXTURES

This invention relates to the stabilization of gasoline which has been diluted with ethanol, i.e. stretched with ethanol containing 3–4% water and which solutions are subject to separation.

In view of the relative shortage and high cost of gasoline, it is desirable to provide some method and means which will stabilize gasoline-ethyl alcohol mixtures, thereby allowing the gasoline-ethyl alcohol mixtures to function at their fullest efficiency, i.e., to exist as a single phase and this even when the ambient temperatures fall below 20° F.

In particular, it would be desirable to provide some method and means which will stabilize gasoline-ethyl alcohol mixtures, wherein the alcohol is ethyl alcohol containing small amounts of water, for instance 3–4%, and is present in an amount of 10% or more and preferably above 20%, so that the phase separation which would normally occur is avoided and the mixture maintained as a single phase.

The use of ethyl alcohol as an extender for gasoline has been proposed. However the successful use of ethyl alcohol has been limited to those instances where the alcohol has been substantially anhydrous. In the presence of even small amounts of water, the ethyl alcohol is no longer miscible with gasoline, bringing about a separation into two phases, especially when there is a drop in ambient temperature. When this occurs, i.e., when the separation into two phases takes place, the bottom phase which consists of water and alcohol is corrosive to the steel brought into contact therewith and in particular the gas tank, pumps, holding tank, etc.

This invention contemplates the use of ethanol which is not anhydrous, but which instead contains 3–4% water. Such alcohol is made by simple distillation methods, instead of the expensive azeotropic distillation procedures which require more energy and the use of costly materials. In addition, the presence of the water introduced with the gasoline-ethanol mixture when used for example in the conventional engine gives rise to an increased octane rating.

The use of an alcohol to hold ethanol and small amounts of water in gasoline solution has already been proposed. Thus it has been suggested to use alcohols such as i-propanol and i-butanol because they are miscible both with water and gasoline.

The applicant has now found that the use of an alcohol such as n-hexanol, which is substantially insoluble in water but which is instead soluble in both gasoline and ethanol has numerous advantages in forming a stable liquid and preventing separation of the gasoline and alcohol. The hexanol is 1-hexanol i.e., the straight chain alcohol, since it has been found that branching materially reduces the effectiveness of this alcohol as a stabilizer, the reduction in effectiveness bearing a direct relationship to the amount of branching present.

It is an object of this invention to provide compositions comprising a fuel oil, i.e., gasoline and ethanol which compositions are stable against separation into more than one phase and that in the presence of small amounts of water and that particularly in the event of a drop in ambient temperature.

Another object of this invention is to provide a method for preventing or retarding the separation into more than one phase of gasoline-ethanol solutions in the presence of small amounts of water.

It is still another object of this invention to provide compositions of matter comprising a high grade fuel oil i.e. gasoline, ethanol and a stabilizing agent therefore.

It is a further object of this invention to provide an additive especially adapted for stabilizing gasoline, particularly mixtures of gasoline and ethanol in the presence of small amounts of water comprising n-hexanol per se or in the form of its solution in the gasoline and/or ethanol. The n-hexanol serves to "couple" the ethanol to the gasoline, forming a stable liquid and preventing separation even in the presence of small amounts of water.

These and other objects and advantages will become more apparent as the description thereof proceeds.

In accordance with this invention, the above objects and advantages are accomplished by the addition to a fuel oil i.e. gasoline-ethanol solution containing small amounts of water of a stabilizing amount of an additive which is both alcohol and gasoline miscible and/or soluble and is effective to prevent the separation of the gasoline-ethanol solution into two distinct phases and namely by using as additive n-hexanol. It is possible in accordance with the invention to employ a mixture of n-hexanol with its isomers such as methyl pentanol, ethyl butanol or the like, but as noted above such mixtures have not been found to be as effective as n-hexanol. Therefore, if n-hexanol is not readily available for the purposes of the invention, it has been found satisfactory to employ n-hexanol and the mixed isomers thereof, as for example produced in the oxo-process. The n-hexanol and/or isomers thereof act to couple the alcohol to the gasoline effectively stabilizing the mixture so that the phase separation which would normally occur when even trace amounts of water are present is avoided.

The stabilizing additive in accordance with the invention, in addition to being miscible with both the ethanol and gasoline phases is also relatively volatile and boils and evaporates in approximately the same range as gasoline, i.e., the stabilizing additive has a flash point below about 145° F.

The additive in accordance with the invention, as noted above is preferably n-hexanol or a mixture thereof with its isomers. However it has been found that the efficiency of this stabilizing additive can be increased if there is included therein a dispersing agent which is itself sufficiently volatile to meet the requirements of a combustion engine. Such a dispersant is 3,5-dimethl-1-hexyn-3-ol.

3.5-dimethyl-1-hexyn-3-ol is a clear colorless volatile liquid having a boiling point of 150°–151° C. Other surfactants similar to the 3,5-dimethyl-1-hexyn-3-ol can be employed, as for instance the Surfynol products (manufactured by Air Products). Such products must be unsaturated and must constitute volatile surface active agents that eventually evaporate from the system containing them, so as to leave no residue to clog the engine or otherwise interfere with its functioning.

The quantity of surfactant utilized amounts to 3–7% preferably 3–5% referred to the stabilizer.

In accordance with another aspect of the invention, in order to reduce any tendency of the water present in the gasoline-ethanol mixture, to bring about corrosion of the steel, it has been found expedient to add a volatile amine and more specifically an alcohol amine, most preferably a glycol amine which is volatile under the conditions of use. One example of a preferred amine for use herein is diglycol amine. Another particularly effective amine is n-butyl amine. If n-butyl amine is employed, then the effectiveness thereof can be further increased by the addition of a small amount of 2-pentanone (methylpropylketone). The pentanone serves to prevent the separation of n-butyl amine from the hexanol. (This is to a great extent due to their overlapping boiling points.) The selection of the amine is in part determined by its flash point which must be sufficiently high that it does not increase the flash point of the gasoline-ethanol-stabilizer-surfactant mixture. Preferably a boiling point of about 135–145° F. is to be strived for. All of the components of the composition as noted are volatile and in use leave no residue in the engine.

According to this invention, stabilizing of the mixture of gasoline and ethanol containing small amounts of water is achieved by the addition of small quantities of the stabilizing additive n-hexanol or its mixture with one or more of its isomers per se or together with the non-ionic surfactant and/or alcohol amine. The additive employed to effect the stabilization may be added to the gasoline-ethanol mixture or to the gasoline or the ethanol prior to forming the mixture. It is preferred however to add the stabilizing additive to the gasoline-ethanol-water mixture.

Thus in accordance with the invention it has now been found that if about 1–20% of the stabilizing additive is introduced into the mixture of gasoline and ethanol containing small amounts of water, the mixture exists as a solution or as one phase.

The stabilizer, as pointed out here and above may be added to the ethanol or to the gasoline prior to forming the mixture thereof or it may be added directly to the gasoline-ethanol mixture. The stabilizer is added in amounts on the order of from about 1–20% and preferably 3–10% based on the mixture of gasoline and ethanol, which amounts have been found to effect a substantially complete stabilizing of the gasoline-ethanol mixtures with which the invention is concerned. Preferred ranges of the stabilizer to be added to the gasoline-ethanol-water mixture range from about 3% to about 12%.

The surfactant and the amine are added directly to the stabilizer, the surfactant in an amount of 3–7% referred to the stabilizer and the amine in approximately like amounts.

The resultant mixture burns clearly without free carbon (soot) and ignites easily in combustion engines.

Using 194 proof ethanol and gasoline (10:90), separation takes place at 30–32° F. If n-hexanol is added in an amount of one part per hundred parts of mixture, no separation takes place until the temperature has fallen to below −25° F. If the mixture includes the surfactant, separation does not take place until the temperature has fallen to below −40° F.

Using 190 proof ethanol and gasoline (10:90) and 2½% either of hexanol, tertiary butanol or isobutyl alcohol, the anticipated separation takes place as follows:

tertiary butyl alcohol: +55° F.
isobutyl alcohol: +24° F.
hexanol: −2° F.

The following examples are set forth for purposes of illustration and are not to be construed as limitations of the present invention except as set forth in the appended claims.

EXAMPLE 1

9 parts of 194 proof ethanol and 90 parts of gasoline (regular unleaded) were mixed together. T this mixture there was added 1 part of a stabilizer having the following composition:

90%: n-hexanol
7%: surfynol (3,5-dimethyl-1-hexyn-3-ol)
3%: diglycol amine

No separation of the mixture took place even when the ambient temperature dropped to about −30° F. When 2% of the above mixture was added separation did not take place until the temperature had reached −65° F.

When isobutyl alcohol was substituted for the n-hexanol, separation was observed at 25–27° F.

EXAMPLE 2

1.5% of n-hexanol was added to 13.5% 193 proof ethanol and this combination added to 85% of gasoline (regular unleaded).

No separation was observed to occur even when the temperature had fallen to below −20° F.

The addition of the stabilizer, n-hexanol in this case is particularly preferred, since the specific gravity of n-hexanol is similar to that of the ethanol facilitating the further processing.

EXAMPLE 3

1.5% of a stabilizing additive having the following composition:

90%: n-hexanol
8%: n-butylamine
2%: 2-pentanone were added to an ethanol-gasoline mixture of the following composition:

13.5%: ethanol (194 proof)
85%: gasoline (leaded or unleaded)

No separation was observed even when the ambient temperature was dropped to below −20° F.

EXAMPLE 4

Example 3 was repeated with identical results using as the stabilizer the following composition:

85%: n-hexanol
12%: n-butylamine
3%: 2-pentanone

I claim:

1. A stabilized composition of matter comprising gasoline, 10–20% of ethanol containing up to 6% of water and 1–20% of a stabilizer n-hexanol in admixture with at least one member from the group consisting of 3,5-dimethyl-1-hexyn-3-ol, diglycolamine, n-butylamine, and n-butylamine plus 2-pentanone, wherein said group member 3,5-dimethyl-1-hexyn-3-ol can be present in an amount of 3–7% referred to the n-hexanol and said amine group member can be present in a total amount of 3–7% referred to the n-hexanol.

2. A stabilized composition of matter according to claim 1 wherein said n-hexanol contains 3,5-dimethyl-1-hexyn-3-ol.

3. A stabilized composition of matter according to claim 1 wherein said n-hexanol contains n-butylamine plus 2-pentanone.

4. A stabilized composition of matter according to claim 1 wherein said hexanol contains diglycolamine.

5. A stabilized composition of matter according to claim 1 wherein said n-hexanol contains n-butylamine.

6. A stabilizer composition for gasoline-ethanol containing up to 6% water comprising n-hexanol in admixture with at least one member from the group consisting of 3,5-dimethyl-1-hexyn-3-ol, diglycolamine, n-butylamine and n-butylamine plus 2-pentanone, wherein said group member 3,5-dimethyl-1-hexyn-3-ol can be present in an amount of 3–7% referred to the n-hexanol and said amine group member can be present in a total amount of 3–7% referred to the n-hexanol.

7. Method of stabilizing gasoline-ethanol containing up to 6% water mixtures which comprises incorporating into such mixture 1–20% of a stabilizer according to claim 16 wherein said ethanol is present in an amount of 10–20% of said mixture to be stabilized.

8. A stabilizer composition for gasoline-ethanol containing up to 6% water mixtures according to claim 6 comprising:

7%: 3,5-dimethyl-1-hexyn-3-ol
90%: n-hexanol
3%: diglycol amine.

9. A stabilizer composition for gasoline-ethanol containing up to 6% water mixtures according to claim 6 comprising 90%: n-hexanol
8%: n-butylamine
2%: n-pentanone

* * * * *